US005983850A

United States Patent [19]

Vilou

[11] Patent Number: 5,983,850

[45] Date of Patent: Nov. 16, 1999

[54] METHODS AND APPARATUS FOR CONTROLLING CUT-OFF OF A MOTOR VEHICLE STARTER

[75] Inventor: Gérard Vilou, Tassin, France

[73] Assignee: Valeo Equipements Electriques Moteur, Tassin, France

[21] Appl. No.: 08/988,577

[22] Filed: Dec. 11, 1997

[30] Foreign Application Priority Data

Dec. 12, 1996 [FR] France ..... 96 15275

[51] Int. Cl.[6] ..... F02N 11/08

[52] U.S. Cl. ..... 123/179.3; 290/38 R

[58] Field of Search ..... 123/179.3, 179.2, 123/179.4; 290/38 R, 38 C

[56] References Cited

U.S. PATENT DOCUMENTS

| | | | |
|---|---|---|---|
| 4,198,945 | 4/1980 | Eyermann et al. | 123/179.3 |
| 4,947,051 | 8/1990 | Yamamoto et al. | 290/38 R |
| 5,197,326 | 3/1993 | Palm | 73/118.1 |
| 5,743,227 | 4/1998 | Jacquet et al. | 123/179.3 |

FOREIGN PATENT DOCUMENTS

| | | |
|---|---|---|
| 40 26 232 | 2/1992 | Germany . |
| 195 03 537 | 8/1996 | Germany . |

*Primary Examiner*—Andrew M. Dolinar
*Attorney, Agent, or Firm*—Morgan & Finnegan, L.L.P.

[57] ABSTRACT

A starter for a motor vehicle internal combustion engine includes an electronic means for controlling cut off of the starter, whereby fluctuations are detected in the signal which correspond to the voltage or current of the starter, the power supply to the starter being interrupted when these fluctuations disappear. The automatic cut-off method includes determining, in the signal, successive periods during which the voltage is constantly increasing, the starter being cut off when one of these periods becomes greater than a given threshold. This threshold is given distinct values, firstly during an inspection time period which begins on closing of the starter contactor, and secondly, after the inspection time period. The duration of the inspection time period is chosen so as to be long enough to include the case in which the first and second fluctuations at the start of the compression strokes of the engines are substantially coincident with each other.

21 Claims, 3 Drawing Sheets

METHODS AND APPARATUS FOR CONTROLLING CUT-OFF OF A MOTOR VEHICLE STARTER

FIELD OF THE INVENTION

This invention relates to starters for motor vehicle engines, and in particular to methods and apparatus for controlling the automatic cut-off of such a starter.

BACKGROUND OF THE INVENTION

In current practice, it is usual, when starting an internal combustion engine of a vehicle for the starter to be cut off, i.e. for the action whereby the starter itself drives the engine, to be terminated, under the direct control of the driver of the vehicle, who for this purpose releases the ignition key from its "start" position when the engine gives out a characteristic sound. However, the prevailing tendency to make engines more and more quiet makes it increasingly difficult for the driver to detect this characteristic sound, and therefore difficult to know when to release the ignition key so as to disengage the starter. This results in the application of unnecessary, and severe, forces between the starter and the engine.

Numerous devices are already known for cutting off (i.e. interrupting the power supply to) a motor vehicle starter when the engine has been successfully started and is sufficiently autonomous to reach its slow running mode by itself. The best of these devices, in terms of performance generally, make use of an analysis of the fluctuations which occur in the power supply voltage to the starter. These fluctuations are due to variations in the current taken by the starter motor during the compression strokes of the internal combustion engine before the latter has been fully started.

It is well known that at the end of the period during which the engine is being driven by the starter, and during the first explosions in the engine, engine speed rises rapidly, so that starter cut-off should take place not only very rapidly, but also at exactly the right moment.

In order to obtain rapid cut-off of the power supply to the starter as soon as the engine has been driven by a sufficient amount, it has previously been proposed, in French patent application No. 96 11792 in the name of Valeo Equipements Electriques Moteur, to provide a cut-off strategy whereby an inspection time period is commenced for each fresh fluctuation, and the power supply to the starter is interrupted when no extreme (maximum or minimum) value has been detected during this inspection time period. The duration of the inspection time period is for example proportional to the duration of the last preceding fluctuation. However, that strategy does not enable acyclic fluctuation to be controlled.

Such acyclic fluctuation is shown in FIGS. 1 and 2 of the accompanying drawings, to which reference is now made. Each of FIGS. 1 and 2 shows a waveform of the starter voltage, plotted against time, at the commencement of the operation of the starter.

The acyclic effect shown in FIG. 1 occurs at the very beginning of the operation of the starter, with a peak $C_1$ at the beginning of the first compression stroke of the engine being hidden in the rising front of the second fluctuation, which has a second peak $C_2$. In other words, in the first two compression strokes, the corresponding fluctuations are substantially coincident with each other. Thus, analysis of the time period $T_1$ for reaching the first detectable peak ($C_2$) in the voltage signal is erroneous, and the inspection time period $D_1$ which is determined, on the basis of the length of the period $T_1$, for the next following cycle of the engine, after the peak $C_2$, is much longer than necessary. Consequently, if starting of the engine occurs at this time, the decision to de-energise the starter, taken at the end of the inspection time period, is late. This substantially reduces the advantages expected from the electronic control system that gives automatic cut-off, such as reduction in wear, reduction in free-wheel noise, and so on.

The acyclic effect illustrated in FIG. 2 occurs during the subsequent phase in which the engine is being driven by the starter, in cases where starting is proving difficult. An explosion which is not followed by further explosions again gives rise to substantial coincidence of fluctuations, so that two successive voltage peaks are brought too close together, as illustrated in FIG. 2 by the peaks $C_3$ and $C_4$. As a result, the first of these peaks, i.e. $C_3$, will tend not to be detected during the corresponding inspection time period $D_2$.

In this case therefore, there is a danger that the close proximity of two explosions to each other will be interpreted by the electronic control system as an indication that the engine has started. The starter will then be stopped prematurely, before the engine has itself started properly, so that the driver then has to commence the starting operation again from the beginning.

In addition, the time $T_3$ used for determining the next inspection time period is also in error.

DISCUSSION OF THE INVENTION

The invention proposes a method of controlling cut off of a motor vehicle starter in which the fluctuations in a signal corresponding to the starter voltage or current are detected, and in which the starter is cut off when the fluctuations cease to occur, the method being such as to enable the above mentioned drawbacks to be overcome.

According to the invention in a first aspect, a method for controlling cut-off of a motor vehicle starter including a starter contactor, in which fluctuations are detected in a signal corresponding to the voltage or current of the starter, and the starter is cut off when the fluctuations disappear, is characterized in that the method includes the step of determining, in the signal, successive time periods during which the voltage is constantly increasing, and cutting off the starter when one of the said time periods becomes larger than a given threshold, and in that the said threshold is given a first distinct value during an inspection time period which is commenced on closure of the starter contactor, and a second, distinct value following the said inspection time period, the inspection time period having a duration which is chosen so as to be long enough to include the cases in which the first and second fluctuations at the start of the compression stroke of the engine are substantially coincident with each other.

The use of these two different strategies at the commencement of operation of the starter, and during the normal driving phase of the starting operation that follows this commencement phase, not only avoids the occurrence of unduly early cut-off, but also avoids excessively late cut-off. Either of these situations could otherwise occur as a result of the acyclic effects in the voltage signal discussed above.

The two threshold values, during the inspection time period and following the latter, respectively, are preferably a function of temperature.

Following the inspection time period, the threshold value is preferably a function, for each new fluctuation, of the duration of at least one preceding fluctuation.

According to a preferred feature of the invention, during the inspection time period, determination of the successive time periods during which the voltage is constantly increasing is commenced only after a given initial time delay.

Preferably, during and following the inspection time period, the signal values corresponding to the maximum value of the peak voltages are memorized, and, following the inspection time period, determination of a time period during which the voltage is constantly increasing is performed only from the instant at which the signal reaches the previously memorized value corresponding to the maximum peak value of voltage.

The signal on which the fluctuations are detected is preferably the power supply voltage of the starter.

According to another preferred feature of the invention, in order to determine the time periods during which the voltage is constantly increasing, the said voltage is sampled, and a decrease is deemed to exist if the last measured value is lower than the preceding value reduced by a constant value dU, an increase in voltage being deemed to exist in all other cases.

The constant value dU is preferably in the range between 50 and 200 millivolts.

According to the invention in a second aspect, there is provided an apparatus for controlling the cut-off of a starter, comprising a signal generating unit which includes means for detecting the fluctuations in a signal corresponding to the voltage or current of the starter, together with means for cutting off the starter when the said fluctuations disappear, characterized in that the said signal generating unit is adapted to perform the method according to the invention in its first aspect.

In a third aspect, the invention provides a motor vehicle starter including such an apparatus.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 3:
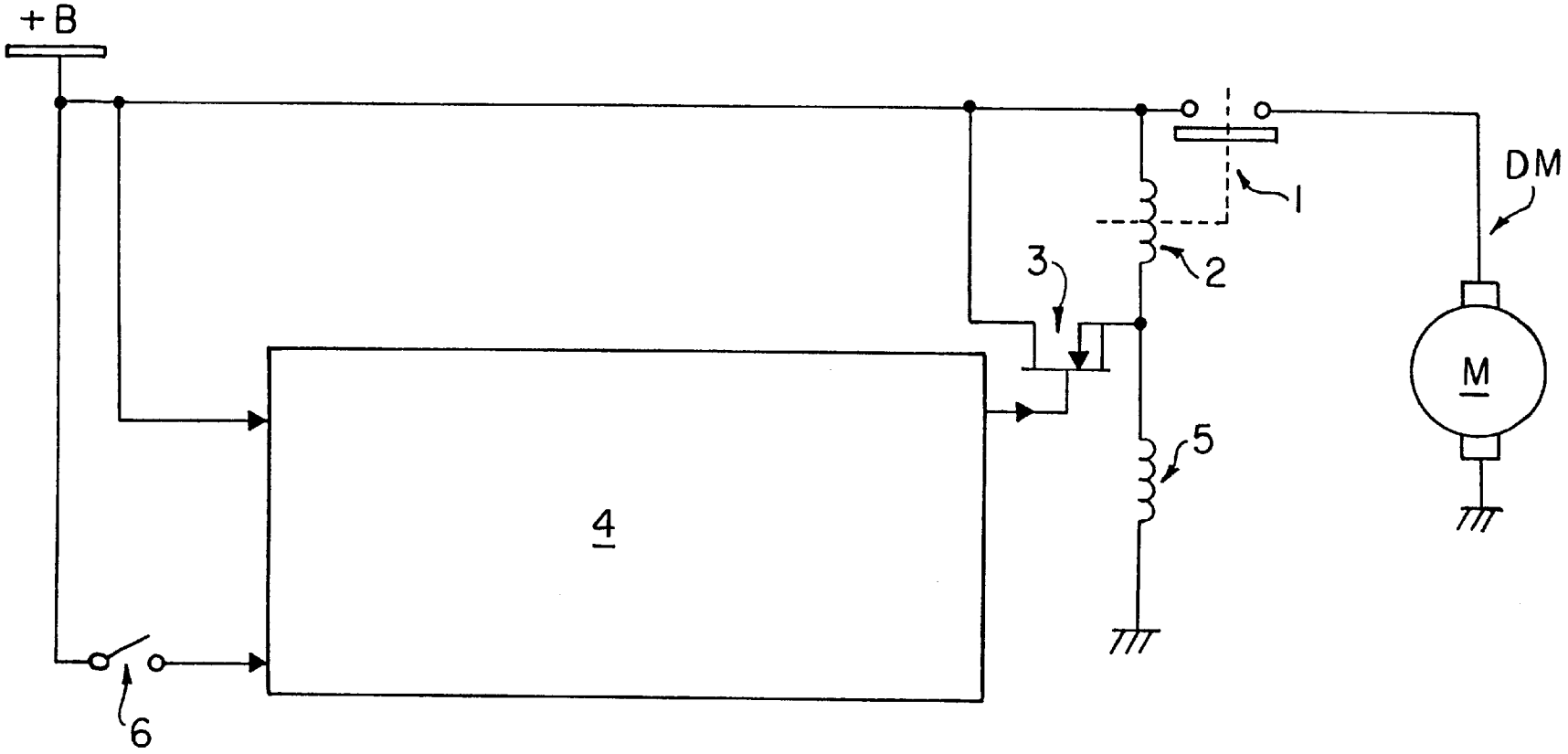
FIG. 3 is a simplified circuit diagram for an electric control device for interrupting a starter, in one possible embodiment of the invention.

FIG. 3 shows a device for controlling the power supply to a starter DM, which comprises an electric motor M connected between a power supply terminal $B^+$ at the voltage of the battery of the vehicle and ground (or earth) of the vehicle.

The starter includes a starter contactor 1 which is connected between the power supply terminal $B^+$ at the voltage U of the battery, and the starter DM. The contactor 1 is a relay which is actuated by a relay winding 2. One of the ends of the winding 2 is connected to the power supply terminal $B^+$. Its other end is connected to the source of a Mosfet transistor 3, and also to an inductance 5 which is connected to ground.

The drain of the transistor 3 is connected to the power supply terminal $B^+$. Its grid is connected to the output of a control unit 4, from which it receives a control voltage. The unit 4 is for example a microprocessor. It will of course be understood that the transistor 3 may be replaced by any other suitable type of interrupter.

In the example shown in the drawings, the unit 4 generates the control voltage as a function, firstly, of the fluctuations in the voltage at the power supply source $B^+$, and secondly of the position of a contactor 6 actuated by the ignition key of the vehicle. This contactor is referred to in this Application as the ignition switch.

Figure 4:
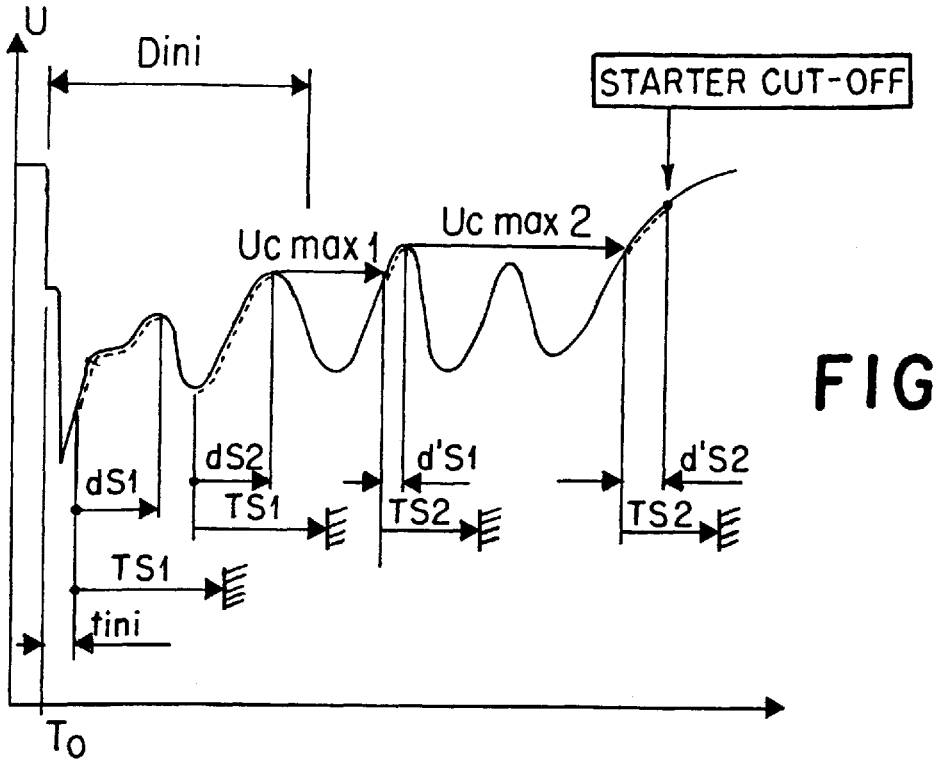
FIG. 4 is a graph which shows an example of the evolution of the voltage of the starter with time, and thereby illustrates a method of operation in accordance with the invention.

The process carried out by the control unit 4 will now be described in detail with reference to FIGS. 4 and 5. This process makes use of one strategy at the outset of the operation of the starter, and a different strategy during the subsequent "normal" phase in which the starter is driving the engine:

At the Outset of Operation of the Starter Initial Phase

An inspection time window having a predetermined duration $D_{ini}$ starts with activation of the starter at an instant $T_o$, which is the instant at which the contacts of the contactor relay 1 are closed. During this inspection window, the control unit 4 determines the durations dS1, dS2, . . . , of the periods during which the voltage U at the power supply terminal $B^+$ is constantly rising. These periods correspond to the representations shown in broken lines in the curve of voltage fluctuations in FIG. 4.

In this example, these determinations do not begin directly at the instant $T_o$, but at an instant $T_o+t_{ini}$, where $t_{ini}$ is a time delay which is so chosen to eliminate the whole of the unstable period of current demand immediately following the moment at which the motor M of the starter is put under a voltage.

In order to determine the periods dS1, dS2, . . . , the control unit 4, over the whole of the inspection time window $D_{ini}$, samples the voltage U and performs a counting operation which is returned to zero each time any voltage decrease appears. The control unit treats as a decrease any situation in which the last measured value is less than the preceding value by a constant amount dU, treating the voltage as increasing under all other circumstances. In this example, the constant dU is a value in the range between 50 and 200 millivolts. The purpose of the constant dU is to enable parasitic effects to be masked without invalidating the analysis.

Figure 1:
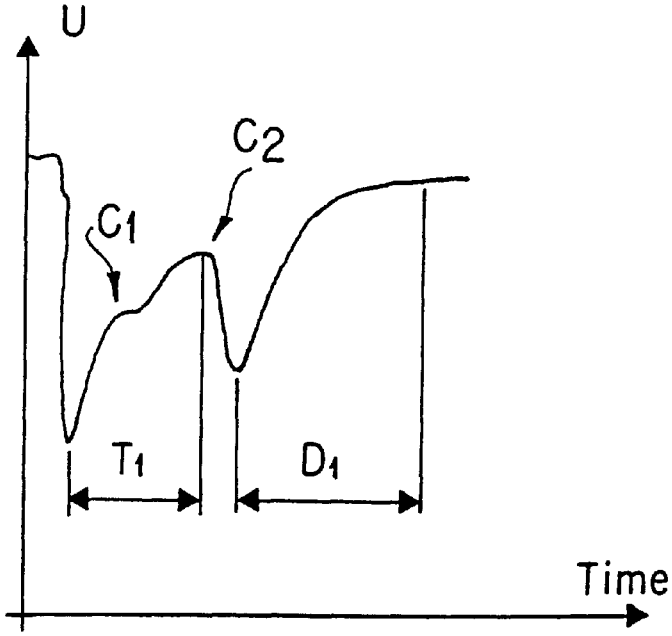
FIGS. 1 and 2, already discussed earlier herein, are graphs showing examples of acyclic fluctuation of the voltage of the starter, as a function of time during a starting phase.
Figure 2:
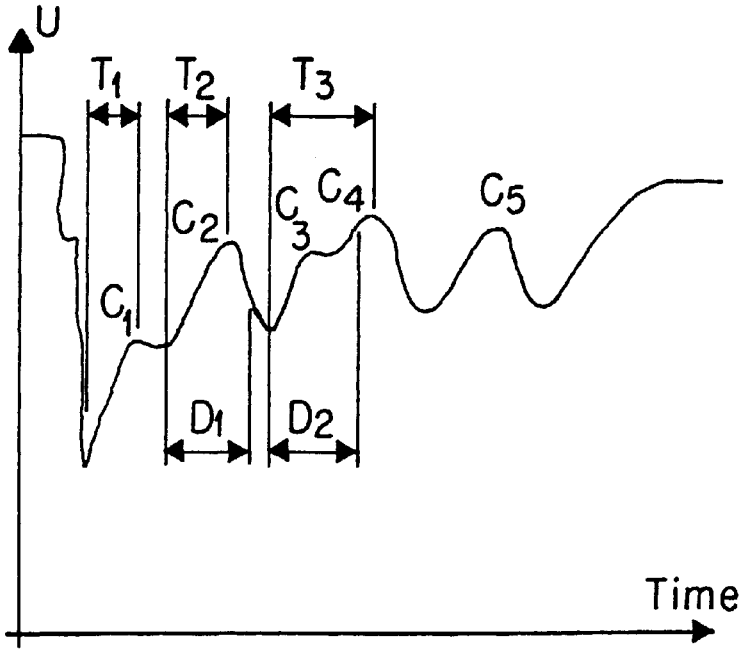

If a value of the duration dS in a rising series dS1, dS2 . . . exceeds a predetermined value TS1, the starter is deactivated. The duration TS1 is of course shorter than the length of the time period $D_{ini}$, and is pre-determined experimentally according to the maximum values that can be envisaged for the period T1 in FIG. 1.

Thus, if starting of the engine takes place, i.e. it begins to run autonomously, during the initial inspection time period $D_{ini}$, the starter is stopped at the end of a fixed period TS1, which enables the irregularities discussed above to be overcome, and enables any excessive delay before any cut-off to be avoided.

The value of the period TS1 is preferably indexed to temperature, in accordance with a predetermined law or table of values.

"Normal" Operation Phase (Following the Initial Phase)

During the whole period $D_{ini}$ and afterwards, the control unit 4 memorises the maximum value $Uc_{max}$ of the voltage U on the various peaks encountered. If at the end of the inspection window $D_{ini}$ the control unit 4 has not issued a command for cut-off of the starter under the circumstances explained above, it continues the process in the following way.

For each new rising front, the unit 4 starts to count down the period (denoted as d'S) during which the voltage U of the power supply $B^+$ is constantly increasing, starting from the instant at which the voltage U has reached the previously memorised value $Uc_{max}$. The starter is deactivated when a time one of these periods d'S (i.e. d'S1, d'S2 etc.) exceeds a pre-determined threshold value TS2.

This value TS2 may be a fixed value for the whole of the next period following the inspection window $D_{ini}$. It may be alternatively, a function of the period for which the preceding fluctuations appear, for example a fraction of the time elapsing from the last two voltage peaks, this elapsed time being determined by a counting operation performed by the control unit 4. Equally, the value or values of TS2 could be loaded by a coefficient which is a function of the ambient temperature of the engine. Thus, at low temperatures, the value of TS2 can be increased in order to ensure sharp and complete starting of the engine before the starter is itself stopped.

It will be noted that by commencing the countdown of a time period d'S only at the instant at which the voltage U becomes greater than the previously memorised value $Uc_{max}$, the lower part of the portion of the voltage curve, the duration of which can be variable according to the starting conditions, is eliminated, and this enables better precision to be achieved.

Figure 5:
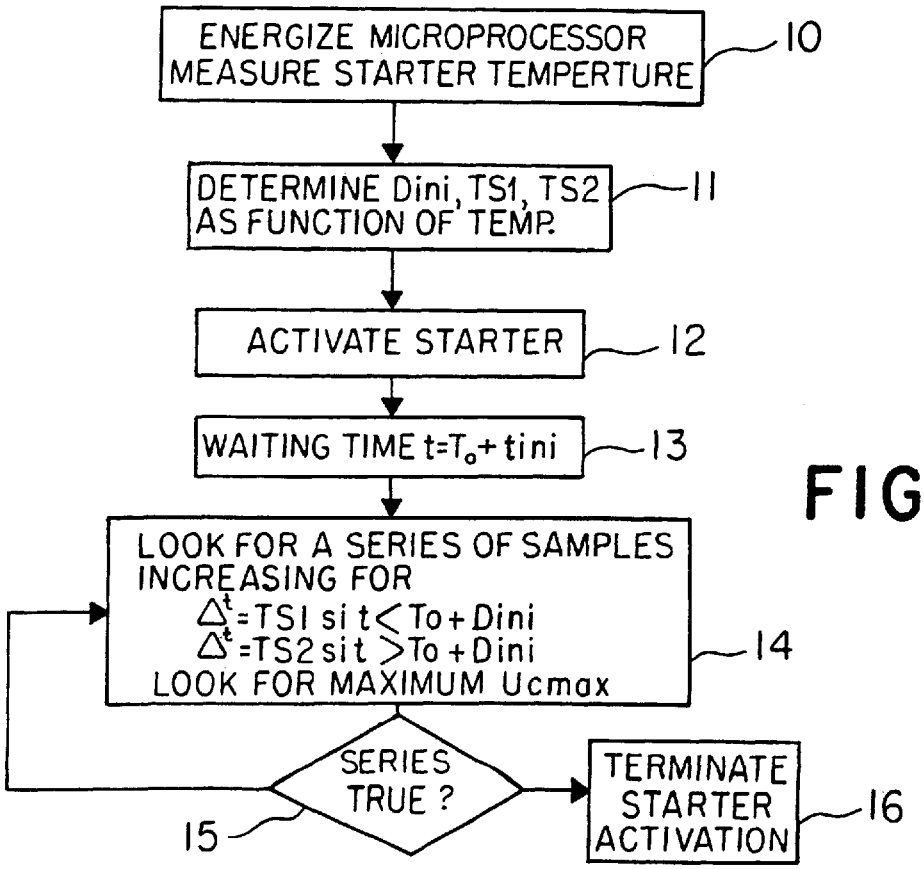
FIG. 5 is a process diagram for a sequence of steps in the method of the invention.

Reference is now made to FIG. 5, which is an operation diagram showing the sequence of operations in the process. In a first step 10, the microprocessor constituting the control unit 4 is energised, and the temperature of the starter is measured.

In a second step (step 11), the microprocessor 4 determines the durations $D_{ini}$, TS1 and TS2 as a function of the temperature measured in step 10. The control unit 4 then issues a control signal for closing of the contactor 1 in step 12, so as to activate the starter.

In the next step, 13, after a time delay until a time $T_o+t_{ini}$, the control unit 4 looks for the first series of samples of voltages that are constantly increasing, during the period TS1 which starts in inspection time window, and which extends to the end of the duration $D_{ini}$ of the latter, and during the first period TS2 beyond the inspection time window. This takes place in step 14.

Simultaneously, the control unit determines, and stores to the extent of the samples taken, the value of the maximum peak voltage $Uc_{max}$. When the control unit 4 finds a series that verifies the above mentioned conditions, it issues a signal for terminating activation of the starter. This is represented by the "Yes" output of step 15 in FIG. 5. If not, step 14 is continued.

Other versions of the method of applying and carrying out the invention are of course possible. In particular, instead of detecting the fluctuations in the voltage signal, the process proposed by the invention could be applied to a signal corresponding to the current taken by the starter, given that the variations in this current are inverse to those in the voltage.

The control unit 4 can of course be incorporated in the starter, or it may consist of a separate unit of the motor vehicle, for example the control unit for the engine itself.

In addition, the control of cut-off of a motor vehicle starter which has been described above has further advantages, other than those previously mentioned. For example, the invention is independent of the engine of the vehicle, independent of the number of cylinders in the engine and its capacity, and independent of age of the battery and wiring, besides being independent of the technology and power output of the starter.

What is claimed is:

1. A method for controlling cut-off of power supplied to an electrical starter for a motor vehicle with an internal combustion engine having a working cycle that includes a compression stroke, the starter including a starter contactor, the method comprising:

detecting a plurality of fluctuations in a signal corresponding to a parameter selected from the group consisting of the voltage of the starter and current of the starter;

determining successive time periods during which the signal is constantly increasing;

interrupting the power supply to the starter when one of the time periods exceeds a predetermined thresholds;

wherein the threshold is a first value during an inspection time period which begins on closure of the contactor, and a second value, distinct from said first value, following the inspection time period;

wherein the inspection time period has a duration which is selected so as to be long enough to include cases where at the beginning of the compression stroke, the first two fluctuations are substantially coincident.

2. A method according to claim 1, wherein the threshold values are a function of temperature during and following the inspection time period.

3. A method according to claim 1, wherein the threshold value for each new said fluctuation is a function of the duration of at least one preceding fluctuation following the inspection time period.

4. A method according to claim 1, further comprising delaying the start of the inspection time period for a predetermined initial delay time, to delay determining successive time periods during which the signal is constantly increasing.

5. A method according to claim 1, further comprising memorizing successive signal values corresponding to the maximum value of peak voltage during and following the inspection time period, and wherein determining successive time periods during which the signal is constantly increasing is only effected starting at the instant when the signal reaches a value corresponding to the last preceding memorized value of maximum peak voltage.

6. A method according to claim 1, wherein the signal on which the fluctuations are detected is the power supply voltage of the starter.

7. A method according to claim 6, wherein determining successive time periods during which the signal is constantly increasing comprises sampling the voltage, a decrease in the voltage being deemed to exist if the last measured value is lower than the preceding value reduced by a constant value dU, and an increase being deemed to exist in all other cases.

8. A method according to claim 7, wherein the constant value dU is in the range between 50 and 200 millivolts.

9. An apparatus for controlling cut-off of an electrical starter for a motor vehicle internal combustion engine, comprising a signal generating unit with (a) means for detecting the fluctuations of a signal corresponding to a parameter selected from the group consisting of the voltage and the current of the starter, and (b) means for interrupting the power supply when said fluctuations cease;

the apparatus being adapted to (1) determine successive time periods during which the signal is constantly increasing, and (2) interrupt the power supply to the starter when one of the time periods exceeds a predetermined threshold;

wherein the threshold is a first value during an inspection time period which begins on closure of the contactor, and a second value, distinct from said first value, following the inspection time period;

wherein the inspection time period has a duration which is selected so as to be long enough to include cases where at the beginning of the compression stroke, the first two fluctuations are substantially coincident.

10. A motor vehicle starter comprising an apparatus for controlling cut-off of an electrical starter for a motor vehicle internal combustion engine, comprising a signal generating unit with (a) means for detecting the fluctuations of a signal corresponding to a parameter selected from the group consisting of the voltage and the current of the starter, and (b) means for interrupting the power supply when said fluctuations cease, the apparatus being adapted to (1) determine successive time periods during which the signal is constantly increasing, and (2) interrupt the power supply to the starter when one of the time periods exceeds a predetermined threshold;

wherein the threshold is a first value during an inspection time period which begins on closure of the contactor, and a second value, distinct from said first value, following the inspection time period;

wherein the inspection time period has a duration which is selected so as to be long enough to include cases where at the beginning of the compression stroke, the first two fluctuations are substantially coincident.

11. A method comprising:

detecting a signal corresponding to the power utilized by an electrical starter associated with an internal combustion engine; and interrupting the power supplied to the starter when the power utilized by the starter increases for a time period exceeding (1) a first predetermined threshold during an initial time period corresponding to at least two compression strokes of the engine or (2) a second predetermined threshold after the initial time period.

12. A method according to claim 11, wherein the first and second predetermined thresholds are a function of temperature.

13. A method according to claim 11, wherein the second predetermined threshold varies according to the duration of a preceding fluctuation.

14. A method according to claim 11, further comprising delaying the start of the initial time period for a predetermined initial delay time after closure of a contactor associated with the starter.

15. A method according to claim 11, further comprising recording the peak power used by the starter during and after the initial time period, wherein determining successive time periods during which the signal is constantly increasing is performed only when the power used by the starter equals or exceeds the recorded peak of a preceding fluctuation.

16. A method according to claim 11, wherein detecting a signal corresponding to the power utilized by an electrical starter comprises measuring voltage supplied to the starter.

17. A method according to claim 16, wherein, in detecting a signal corresponding to the power utilized by an electrical starter, an increase is deemed to exist, unless the last measured value is lower than the preceding value reduced by a constant value dU.

18. A method according to claim 17, wherein the constant value dU is approximately in the range between 50 and 200 millivolts.

19. A motor vehicle starter comprising:

a sensor adapted to detect fluctuations in power utilized by the electrical starter, and an actuator configured to interrupt the power supplied to the starter when the power utilized by the starter increases for a time period exceeding (1) a first predetermined threshold during an initial time period corresponding to at least two compression strokes of the engine or (2) a second predetermined threshold after the initial time period.

20. A motor vehicle starter comprising:

means for detecting a signal corresponding to the power utilized by an electrical starter associated with an internal combustion engine; and means for interrupting the power supplied to the starter when the power utilized by the starter increases for a time period exceeding (1) a first predetermined threshold during an initial time period corresponding to at least two compression strokes of the engine or (2) a second predetermined threshold after the initial time period.

21. A motor vehicle comprising a motor vehicle starter including a sensor adapted to detect fluctuations in power utilized by the electrical starter, and an actuator configured to interrupt the power supplied to the starter when the power utilized by the starter increases for a time period exceeding (1) a first predetermined threshold during an initial time period corresponding to at least two compression strokes of the engine or (2) a second predetermined threshold after the initial time period.

* * * * *